US006191535B1

(12) United States Patent
Saitou

(10) Patent No.: US 6,191,535 B1
(45) Date of Patent: Feb. 20, 2001

(54) ELECTROLUMINESCENCE DISPLAY APPARATUS

(75) Inventor: Yoshinori Saitou, Gifu (JP)

(73) Assignee: Sanyo Electric Co., Ltd., Osaka (JP)

( * ) Notice: Under 35 U.S.C. 154(b), the term of this patent shall be extended for 0 days.

(21) Appl. No.: 09/447,147

(22) Filed: Nov. 23, 1999

(30) Foreign Application Priority Data

Nov. 27, 1998 (JP) ..... 10-337842

(51) Int. Cl.[7] ..... G09G 3/10
(52) U.S. Cl. ..... 315/169.3; 345/76; 345/197
(58) Field of Search ..... 315/169.1, 169.3; 345/55, 76, 89, 197, 204

(56) References Cited

U.S. PATENT DOCUMENTS 5,302,966 * 4/1994 Stewart ..... 315/169.3
5,309,150 * 5/1994 Ohba et al. ..... 345/76
5,652,600 * 7/1997 Khormaei et al. ..... 345/76

* cited by examiner

*Primary Examiner*—Don Wong
*Assistant Examiner*—Thuy Vinh Tran
(74) *Attorney, Agent, or Firm*—Cantor Colburn LLP

(57) ABSTRACT

EL devices each having an emissive layer (6) between an anode (3) and a cathode (4) are employed in a passive matrix display apparatus. To drive each device, the anodes and cathodes are arranged in a matrix configuration, and scan signals are supplied to the cathodes (4) from a row driver (8) and pulse width modulation signals having pulse widths proportional to gray scales are supplied to the anodes (3) from a column driver (9) as column driving signals COL1, COL2, COL3, . . . , COLm. The output start timing of the column driving signals COL1, COL2, COL3, . . . , COLm is set to be different for every column. This prevents the output timing of the column driving signal from coinciding at neighboring columns, eases the concentration of supply current, and reduces power consumption.

5 Claims, 5 Drawing Sheets

ELECTROLUMINESCENCE DISPLAY APPARATUS

BACKGROUND OF THE INVENTION

1. Field of the Invention

The present invention relates to a passive matrix electroluminescence (EL) display apparatus in which organic EL devices are driven using pulse width modulation signals.

2. Description of the Related Art

Organic EL devices are ideal for thin configurations as they emit light and do not require the backlight that is required in liquid crystal displays, and they do not have restrictions in viewing angle. Thus, the application of organic EL devices is highly expected in the next generation of display devices.

As shown in an example in FIG. 1, an organic EL device 1 is formed from a hole-transport layer 5, which is formed from MTDATA (4,4'-bis(3-methylphenylphenylamino) biphenyl), an emissive layer 6, which is formed from TPD (4,4',4"-tris(3-methylphenylphenylamino)triphenylanine) and Rubrene, and an electron-transport layer 7, which is formed from Alq3, between an anode (first electrode) 3, which is formed from a transparent electrode, such as ITO, on a transparent glass substrate 2, and a cathode (second electrode) 4, which is formed from an MgIn alloy. Holes injected from the anode 3 and electrons injected from the cathode 4 are recombined within the emissive layer 6 to emit light, which is radiated outward from the transparent anode side in the direction of the arrow shown in the figure.

Display apparatuses for driving this sort of organic EL device can be divided into two types: a passive matrix type, and an active matrix type using TFTs. A schematic circuit diagram of the passive matrix type is shown in FIG. 2.

Namely, of the pair of electrodes of the EL devices described above, the anodes 3 are designated for columns, the cathode 4 are designated for rows, and they are arranged in a matrix configuration so as to cross each other and sandwich an organic layer. To the cathodes 4 are supplied scan signals ROW1, ROW2, ROW3, and so forth, from a row driver 8, the scan signal of only the selected row of a plurality of rows becomes a low level for one horizontal period while the scan signals for the other rows become a high level. Meanwhile, a column driver 9 inputs gray-scale data mDATA for expressing the display gray scale of each pixel, and pulse signals having pulse widths proportional to this gray-scale data are output as column driving signals COL1, COL2, COL3, . . . , COLm. The column driving signals COL1, COL2, COL3, . . . , COLm are at a high level during the pulse width period, thus, the EL device of the row that inputs the low level scan signal emits light.

The configuration of the column driver 9 will be described in detail with reference to FIG. 3.

The column driver 9 comprises a shift register 10 for inputting n-bit gray-scale data mDATA for each column according to a shift clock CL, a latch circuit 11 for latching the data input by the shift register 10 according to a latch pulse, an n-bit counter 12 for expressing the gray-scale level, and m pulse width modulation circuits 13 for comparing the n-bit gray-scale data from the latch circuit 11 provided for every column and the n-bit counter value, and respectively outputting the column driving signals COL1, COL2, COL3, . . . , COLm of pulse widths proportional to the gray-scale data. In the passive matrix EL display apparatus, the column driving signals COL1, COL2, COL3, . . . , COLm are output from the respective pulse width modulation circuits 13 as shown in FIG. 4.

The counter value of the n-bit counter 12, as shown in FIG. 4 when n=3, for example, changes in a sequence of "0", "1", . . . , "7" during one horizontal scan period (1H), and the column driving signals COL1, COL2, COL3, . . . , COLm all simultaneously start their output at a timing when the counter value reaches "1". The high level during the pulse width period is maintained in proportion to the gray-scale data of the respective pixel. Therefore, pixels PX1, PX2, PX3, . . . , PXm of the same row shown in FIG. 2 emit light during the pulse width periods shown in FIG. 4, and the gray scales are expressed by these light emitting periods.

In the above-mentioned EL display apparatus, gray scales are expressed by the pulse widths of the pulse width modulation signals that are output as the column driving signals COL1, COL2, COL3, . . . , COLm as described above, and the output start timing is the same for all signals. Therefore, at the initial timing when the counter value becomes "1", the current concentrates in its flow from the anode 3 to the cathode 4 to result in an extremely high current consumption at this time. However, the gray scale of the pixel is dependent on the high level period during one horizontal scan period and is not dependent on the generated position of the pulse width modulation signal.

SUMMARY OF THE INVENTION

It is therefore an object of the present invention to provide a passive matrix EL display apparatus that avoids the concentration of current consumption and achieves reliable gray-scale displays.

To achieve the above-mentioned object, the electroluminescence display apparatus employing electroluminescence devices as light emitting pixels in the present invention comprises: the electroluminescence devices, each having an emissive layer between a first electrode and a second electrode, in which the first electrodes and the second electrodes are disposed in a matrix configuration so as to mutually cross; a first driver circuit for supplying scan signals to the second electrodes; and a second driver circuit for supplying pulse width modulation signals, having a pulse width proportional to a gray scale, as driving signals to the first electrodes, and for outputting the driving signals at different timings for every column of the matrix.

In another aspect of the present invention, the second driver circuit shifts the output timing of the driving signals by a predetermined timing between adjacent first electrodes.

By shifting the output timing of the driving signal for every column in this manner, concentration of the supply current can be prevented and the power consumption of the apparatus can be reduced.

In a further aspect of the present invention, the second driver circuit comprises: a counter for counting a counter pulse that is generated at every period, which is one horizontal scan period divided by the number of display gray scales; and a pulse width modulation circuit for determining the pulse width and amount of delay of the output start timing of the driving signal according to the gray-scale level to be displayed, and the number of the column to which output is to be performed, on the basis of the count value at the counter, and for outputting the driving signal to the relevant column.

In another aspect of the present invention, the pulse width modulation circuit: for a case where the less significant n bits of the column number are expressed as m, compares a less significant n bit data nP of addition data of n-bit gray-scale data mDATA and m−1 data for column m, with a count value nT of the counter, and generates a signal A at a high level during the period when the count value nT satisfies nT≦nP; for a case where the most significant bit Q of the addition data is 0, inhibits the output of the signal A at a high level by a signal B until the count value nT of the counter is nT>m−1, and outputs signal A, which is enabled by the signal B, as the driving signal, and for a case where the most significant bit Q of the addition data is 1, generates a signal C at a high level only when the count value nT of the counter is nT≧m−1, and outputs signal A and signal C as driving signals.

As mentioned above, the gray-scale data for the corresponding column, the count value of the counter proportional to the number of gray-scale levels set in the apparatus, the pulse width of the driving signal, and the output timing of the driving signal according to the number m of the column to which the driving signal is to be supplied are determined. For this reason, with a relatively simple configuration, the output timing of the driving signal for every column can be controlled, the gray scale can be accurately pulse-width modulated, and a gray-scale display can be performed at each of the light emitting pixels that are formed at the intersections of the first electrodes and second electrodes, which are arranged in columns and rows.

DETAILED DESCRIPTION OF THE PREFERRED EMBODIMENTS

Figure 1:
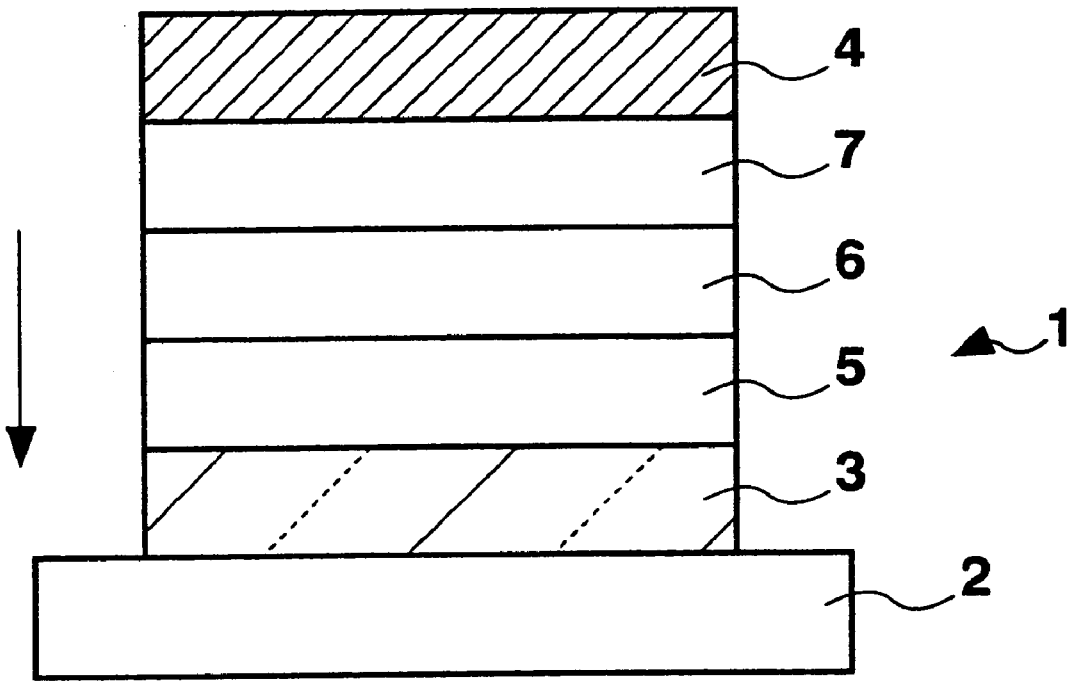
Fig. 1 PRIOR ART
FIG. 1 is a sectional view showing the structure of an EL device.
Figure 2:
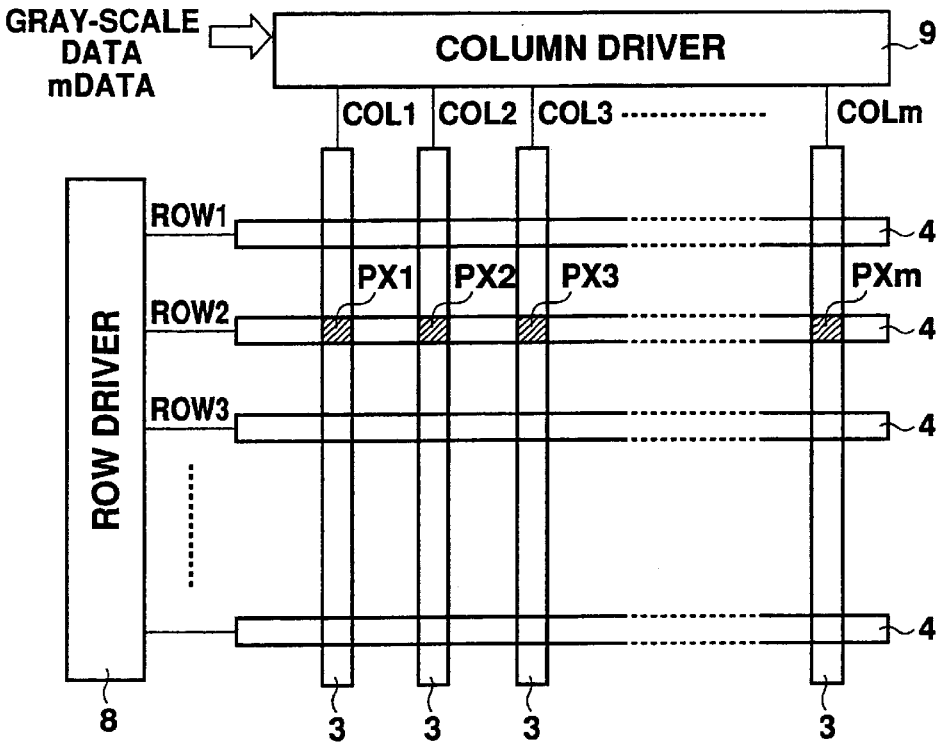
FIG. 2 is a circuit diagram showing the basic configuration of a passive matrix EL display apparatus.
Figure 3:
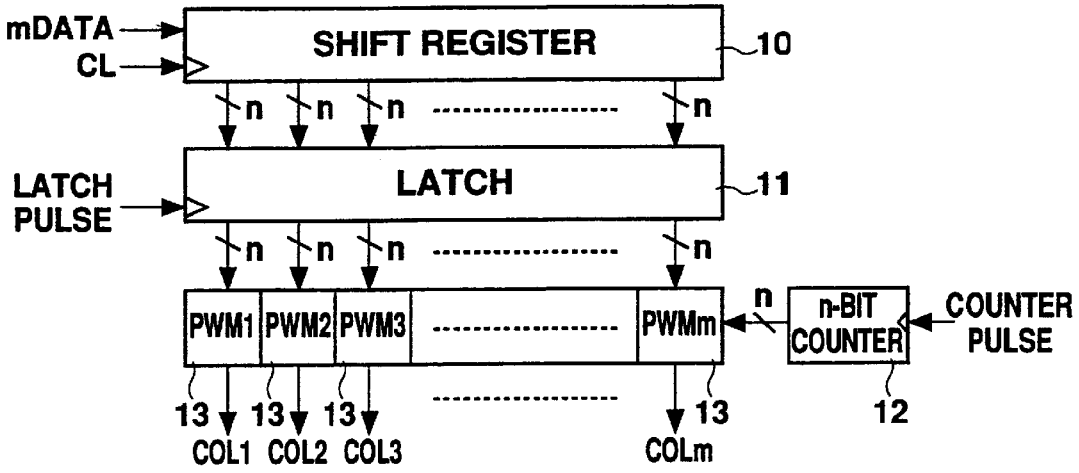
FIG. 3 is a circuit diagram showing the configuration of a column driver in the passive matrix EL display apparatus.

In the passive matrix EL display apparatus according to the present invention, the EL device structure, the basic circuit configuration of the apparatus, and the column driver configuration are identical to that shown in FIG. 1, FIG. 2, and FIG. 3, respectively. However, the pulse width modulation circuits 13 of FIG. 3 are different from the above-mentioned apparatus.

Figure 4:
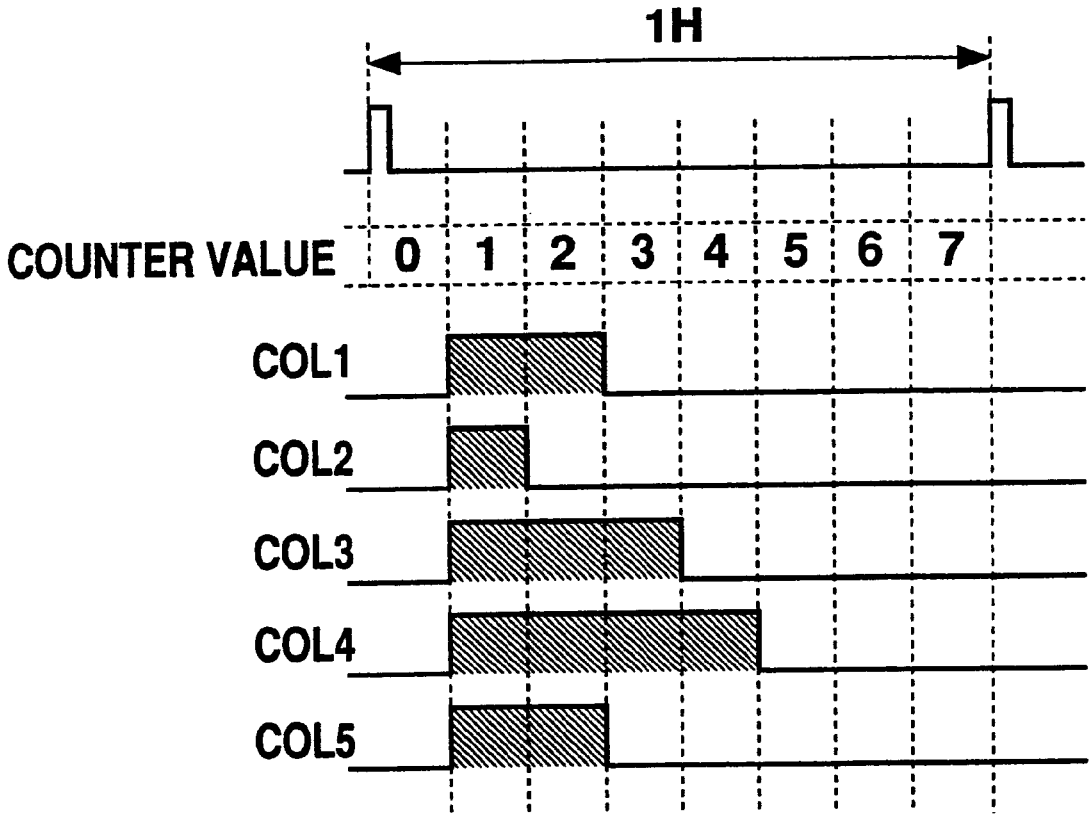
FIG. 4 is a timing chart illustrating the operation of a conventional passive matrix EL display apparatus.
Figure 5:
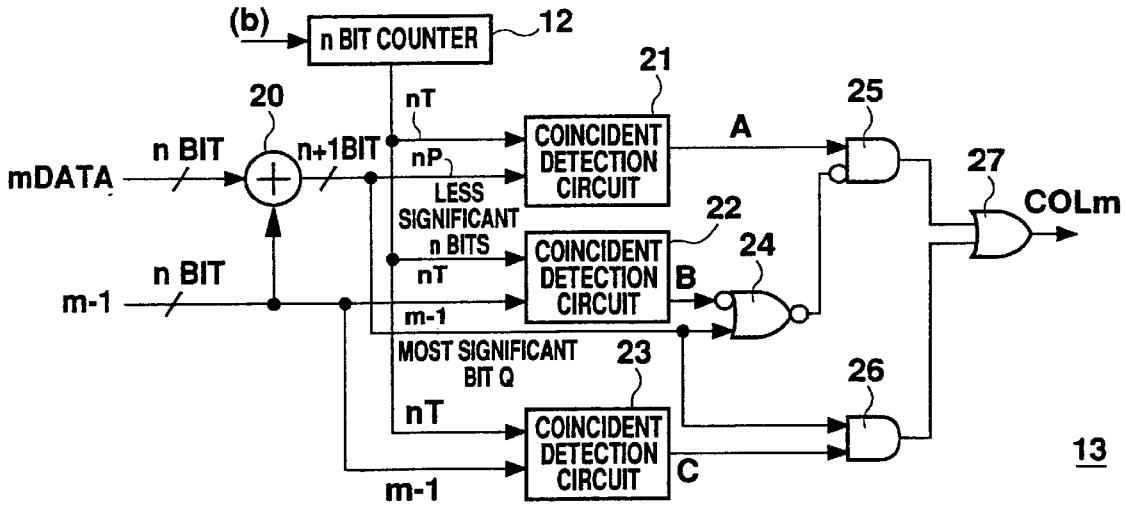
FIG. 5 is a circuit diagram showing the major components of an embodiment of the present invention.

FIG. 5 is a circuit diagram showing a pulse width modulation circuit (circuit 13 of FIG. 3) of the m-th column according to the present invention, and the pulse width modulation circuits of the other columns shown in FIG. 3 also have an identical configuration to that shown in FIG. 4.

In the figure, MDATA is an n-bit gray-scale data for the m-th column that is input, and (m−1) is an n-bit fixed data that is generated within the pulse width modulation circuit for every column. An adder 20 adds both these data items, and a coincidence detection circuit 21 compares the less significant n bits of data nP of the (n+1) bit addition data that is output from the adder 20 with a counter value nT of the n-bit counter 12. An output A become a high level from the time when the counter value nT becomes "1", and drops to a low level when nT>nP. A coincidence detection circuit 22 compares the fixed data (m−1) with the counter value nT of the n-bit counter 12. An output B becomes a high level from the time when the counter value nT becomes "1", and drops to a low level when nT>(m−1).

Furthermore, a coincidence detection circuit 23 compares the fixed data (m−1) with the counter value nT of the n-bit counter 12, and an output C becomes a high level only when nT>(m−1). A NOR gate 24 inputs an inverted signal of the output B and the most significant bit Q of the addition data, an AND gate 25 uses for its inputs the output A and an inverted signal of the NOR gate 24, an AND gate 26 uses for its inputs the most significant bit Q of the addition data and the output C, and an OR gate 27 uses for its inputs the outputs of both AND gates 25 and 26.

The operation of the embodiment will be described hereinafter with reference to the timing chart of FIG. 6.

Figure 6:
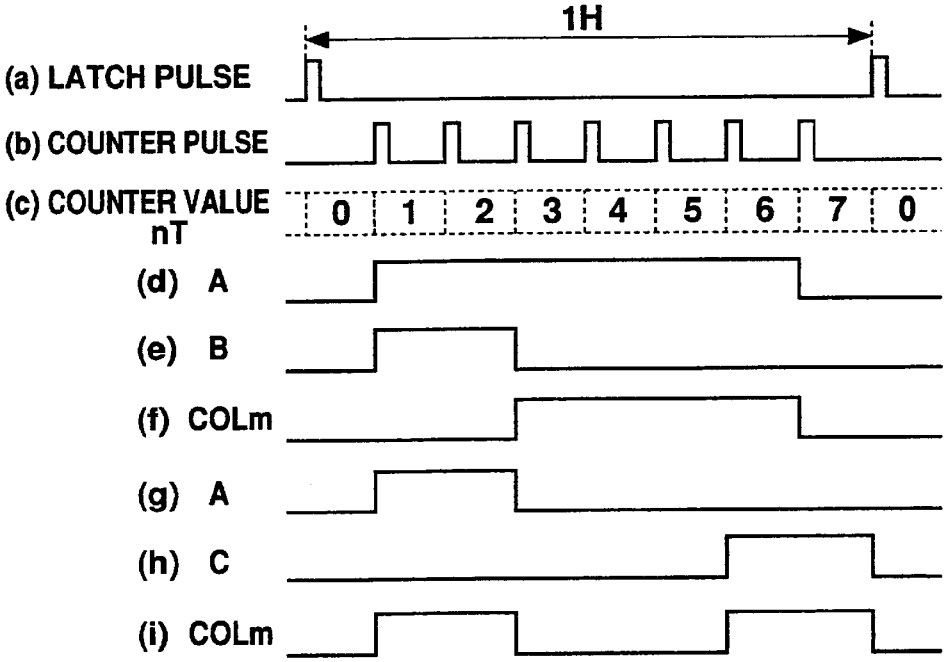
FIG. 6 is a timing chart illustrating the operation of a pulse width modulation circuit in the embodiment.

First, the latch pulse shown in FIG. 6(*a*) is the signal that is input by the latch circuit 11 of FIG. 3 and is output at every horizontal scan period (1H). The counter pulses shown in FIG. 6(*b*) are input by the n-bit counter 12. The n-bit counter 12 counts these counter pulses so as to change the counter value nT in a sequence of "0", "1", . . . , "7" in one horizontal scan period as shown in FIG. 6(*c*).

An operation will be described hereinafter for an instance where gray-scale data mDATA=4 is input from the latch circuit 11 by the third column pulse width modulation circuit (m=3).

In this case, (m−1)=2 so that the addition data that is output from the adder 20 becomes mDATA+(m−1)=6 and the less significant n-bit data nP of the addition data becomes "6". The coincidence detection circuit 21 sets the output A as described above to a high level from the time when the counter value nT becomes "1" and drops the output A to a low level when nT>nP. Thus, as shown in FIG. 6(*d*),the output A becomes a high level during the period when the counter value nT is from "1" to "6". Meanwhile, the coincidence detection circuit 22 sets the output B to a high level from the time when the counter value nT becomes "1" and drops the output B to a low level when nT>(m−1). Thus, as shown in FIG. 6(*e*), the output B becomes a high level during the period when the counter value nT is from "1" to "2".

Furthermore, in this example, the most significant bit Q of the addition data is "0" so that the output B of the coincidence detection circuit 24 is output from the NOR gate and its inverted signal is input by the AND gate 25. Thus, from the AND gate 25, a high level signal is output during the period when the signal A is high and the signal B is low, namely, the period when the counter value nT is from "3" to "6", and this signal is output as the column driving signal COL3 from the OR gate 27 as shown in FIG. 6(*f*). In this manner, from the pulse width modulation circuit of the m-th column, a high-level pulse width modulation signal is output during the period when the counter value is from "m" to "(m−1)+MDATA".

Figure 7:
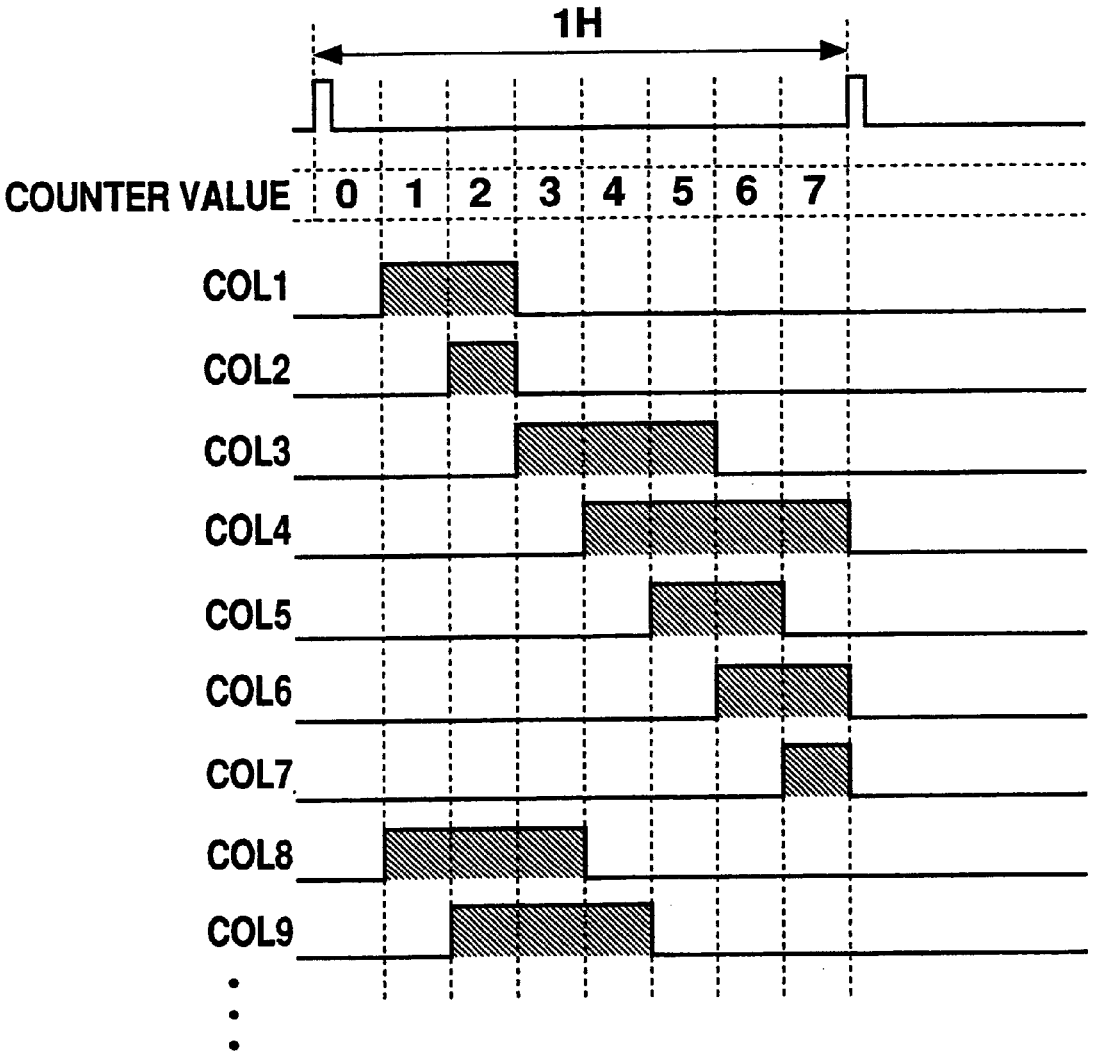
FIG. 7 is a timing chart illustrating the operation of a column driver in the embodiment.

Therefore, as shown in FIG. 7, the column driving signals COL1, COL2, COL3, . . . , COLm have their output start timings sequentially shifted by one counter value so that a concentration of current consumption at the initial counter value, such as "1", can be avoided. However, since the pulse width itself during one horizontal scan period has the same width as in the prior art, reliable gray-scale control is achieved as in the prior art.

Described in more detail, "m" expresses only the less significant n bits of the column number and n=3 in the aforementioned example so that the output start timing from the first column to the seventh column is each shifted by one counter value. The output start timing thereafter from the eighth column and so forth again returns to the timing for the first column, after which it is shifted by one counter value at a time. Namely, the output start timing repeats the same timing every eight columns.

However, the method of output of the column driving signal differs slightly in the case given below.

For example, in the case of mDATA=4 at m=7, the addition data "mDATA+(m−1)" of the (n+1) bits from the adder 20 becomes "10" and exceeds the gray-scale level "8". In this case, the most significant bit Q of the addition data is "1" so that the output of the NOR gate 24 is fixed at "0" regardless of the level of output B, thus, the output A from the AND gate 25 is output without change. The less significant n-bit data nP of the addition data is "2" in this case so that output A, which becomes a high level as shown in FIG. 6(*g*) when the counter value is from "1" to "2", is generated from the coincidence detection circuit 21. Meanwhile, the coincidence detection circuit 23 sets output C to a high level only during the period when nT≧(m−1) so that output C is a high level as shown in FIG. 6(*h*) when the counter value is from "6" to "7". Since the AND gate 26 inputs the output C and the most significant bit Q of the addition data, the output C is output without change when Q is "1". This output C and the output A of FIG. 6(*g*) are supplied to the OR gate 27 so that the column driving signal COL7 is a high level when the counter value is from "1" to "2" and from "6" to "7" as shown in FIG. 6(*i*). As a result, the total of the high level periods is the four-pulse period specified by the gray-scale data mDATA.

In this manner, when the addition data exceeds the gray-scale level "8", a distributed pulse signal results, and in this case also, the output start timing of the driving signals differs for every column.

According to the present embodiment as described above, in the passive matrix EL display apparatus, shifting the output start timing of the driving signals can achieve a reliable gray-scale display while avoiding concentration of the current consumption.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An electroluminescence display apparatus employing electroluminescence devices as light emitting pixels and comprising:

electroluminescence devices, each having an emissive layer between first electrodes and second electrodes, in which said first electrodes and said second electrodes are disposed in a matrix configuration so as to mutually cross;

a first driver circuit for supplying scan signals to said second electrodes; and a second driver circuit for supplying pulse width modulation signals, having a pulse width proportional to a gray scale, as driving signals to said first electrodes, and for outputting said driving signals at different start timings for every column of the matrix during a period when each row of the matrix is selected by a scan signal.

2. The electroluminescence display apparatus according to claim 1 wherein said second driver circuit shifts the output timing of said driving signals by a predetermined timing between said first electrodes in adjacency.

3. The electroluminescence display apparatus according to claim 1 wherein said second driver circuit comprises:

a counter for counting a counter pulse that is generated at every period, which is one horizontal scan period divided by the number of display gray scales; and a pulse width modulation circuit for determining the pulse width and amount of delay of the output start timing of the driving signal according to the gray-scale level to be displayed, and the number of the column to which output is to be performed, on the basis of the count value at said counter, and for outputting said driving signal to the relevant column.

4. The electroluminescence display apparatus according to claim 3 wherein said pulse width modulation circuit:

for a case where the less significant n bits of the column number are expressed as m, compares a less significant n bit data nP of addition data of n-bit gray-scale data mDATA and m−1 data for column m, with a count value nT of said counter, and generates a signal A at a high level during the period when the count value nT satisfies nT≦nP;

for a case where the most significant bit Q of said addition data is 0, inhibits the output of said signal A at a high level by a signal B until the count value nT of said counter is nT>m−1, and outputs signal A, which is enabled by said signal B, as the driving signal; and for a case where the most significant bit Q of said addition data is 1, generates a signal C at a high level only when the count value nT of said counter is nT≧m−1, and outputs signal A and signal C as said driving signals.

5. The electroluminescence display apparatus according to claim 1 wherein said electroluminescence devices are driven by a direct current to provide a luminescence display.

* * * * *

UNITED STATES PATENT AND TRADEMARK OFFICE

CERTIFICATE OF CORRECTION

PATENT NO. : 6,191,535 B1
DATED : February 20, 2001
INVENTOR(S) : Yoshinori Saitou It is certified that error appears in the above-identified patent and that said Letters Patent is hereby corrected as shown below:

Column 1,
Line 36, delete “cathode” and insert therefor -- cathodes --

Column 3,
Line 47, delete “that” and insert therefor -- those --

Column 4,
Line 44, after “circuit” delete “24” and insert therefor -- 22 --
Line 44, after “gate” insert therefor -- 24 --

Signed and Sealed this

Sixth Day of July, 2004

JON W. DUDAS
*Acting Director of the United States Patent and Trademark Office*